US007431673B2

(12) United States Patent
Niwa et al.

(10) Patent No.: US 7,431,673 B2
(45) Date of Patent: Oct. 7, 2008

(54) RACKET

(75) Inventors: Kunio Niwa, Hyogo (JP); Takeshi Ashino, Hyogo (JP)

(73) Assignee: SRI Sports Limited, Kobe-shi (JP)

( * ) Notice: Subject to any disclaimer, the term of this patent is extended or adjusted under 35 U.S.C. 154(b) by 0 days.

(21) Appl. No.: 11/448,044

(22) Filed: Jun. 7, 2006

(65) Prior Publication Data

US 2007/0026977 A1 Feb. 1, 2007

(30) Foreign Application Priority Data

Jul. 26, 2005 (JP) ..... 2005-215883

(51) Int. Cl.
*A63B 49/02* (2006.01)

(52) U.S. Cl. ..... 473/543; 473/524; 473/540; 473/546

(58) Field of Classification Search ..... 473/524, 473/540, 543, 546
See application file for complete search history.

(56) References Cited

U.S. PATENT DOCUMENTS

| | | | | | |
|---|---|---|---|---|---|
| 1,460,665 | A | * | 7/1923 | Gallaudet | 473/543 |
| 1,980,783 | A | * | 11/1934 | Cook et al. | 473/543 |
| 2,089,118 | A | * | 8/1937 | Fritsch | 473/534 |
| 4,138,109 | A | * | 2/1979 | Nobbs | 473/539 |
| 4,322,076 | A | * | 3/1982 | Bertram et al. | 473/537 |
| 4,333,650 | A | * | 6/1982 | Soong | 473/537 |
| 4,828,259 | A | * | 5/1989 | Davis | 473/522 |
| 5,020,800 | A | * | 6/1991 | Chen | 473/522 |
| 5,141,228 | A | * | 8/1992 | Soong | 473/521 |
| 5,263,712 | A | * | 11/1993 | Lo | 473/522 |
| 5,306,004 | A | * | 4/1994 | Soong | 473/522 |
| 5,702,313 | A | * | 12/1997 | Stennett | 473/546 |
| 5,919,104 | A | * | 7/1999 | Mortvedt et al. | 473/540 |
| 6,319,158 | B1 | * | 11/2001 | Cheng | 473/522 |
| 6,432,005 | B1 | * | 8/2002 | Lin | 473/540 |
| 6,561,933 | B1 | * | 5/2003 | Hsu | 473/521 |
| 6,811,502 | B1 | * | 11/2004 | Janes et al. | 473/546 |
| 6,935,975 | B2 | * | 8/2005 | Chang et al. | 473/549 |
| 7,097,576 | B2 | * | 8/2006 | Filippini | 473/540 |
| 7,140,985 | B2 | * | 11/2006 | Filippini | 473/543 |
| 7,144,341 | B1 | * | 12/2006 | Filippini | 473/543 |
| 2007/0026977 | A1 | * | 2/2007 | Niwa et al. | 473/524 |

FOREIGN PATENT DOCUMENTS

| | | | |
|---|---|---|---|
| GB | 2226250 | A * | 6/1990 |
| JP | 2000-61004 | A | 2/2000 |
| JP | 2001-252376 | A | 9/2001 |

* cited by examiner

*Primary Examiner*—Raleigh W. Chiu
(74) *Attorney, Agent, or Firm*—Birch, Stewart, Kolasch & Birch, LLP

(57) ABSTRACT

In a racket frame, a yoke part is disposed between left and right portions of a bifurcated throat part continuous with a head part and with a shaft part. A ball-hitting face is formed with the yoke part and the head part. The head part and the yoke part have a plurality of string holes formed in penetration therethrough to insert longitudinal and transverse strings therethrough. Longitudinal string holes formed outside left and right sides of the yoke part connected with the left and right portions of the throat part are extended to the throat part to form extended longitudinal string holes open on an outer surface of the throat part.

10 Claims, 13 Drawing Sheets

[Prior Art]

[Prior Art]

RACKET

This Nonprovisional application claims priority under 35 U.S.C. § 119(a) on Patent Application No(s). 2005-215883 filed in Japan on Jul. 26, 2005, the entire contents of which are hereby incorporated by reference.

FIELD OF THE INVENTION

The present invention relates to a tennis racket and the like and particularly a racket having a large sweet area by increasing the stretched length of a longitudinal string.

DESCRIPTION OF THE RELATED ART

As shown in FIG. 12, in the conventional racket frame, string holes 2 are formed in penetration through the head part and the yoke part in the direction from an inner peripheral side 1*a* of the racket frame 1 to a peripheral side 1*b* thereof by using a drill, with the string holes 2 disposed vertically to a tangent to the circular arc-shaped racket frame 1 surrounding the ball-hitting face. An operation of forming the string holes 2 in the above-described way can be performed simply and allows the required length of a string S to be shorter than any other ways.

The string to be stretched on the racket frame is composed of longitudinal strings stretched in parallel or approximately parallel with the axial line of the racket frame drawn from the top of the ball-hitting face to the center of the grip and transverse strings stretched orthogonally to the longitudinal strings.

Except the longitudinal string passing through the top of the racket frame 1 and the transverse string passing through both sides of the head part having the longest width, the string-stretched direction is not coincident with the direction in which the string holes 2 are formed in penetration through the racket frame 1. Because the string S is bent in contact with an inner peripheral edge 2*a* of the string hole 2 disposed at the inner peripheral surface of the racket frame 1, the effective length of the string S is equal to the length between the inner peripheral edges 2*a* of the opposed string holes 2.

The sweet area of the racket frame can be increased by increasing the effective length of the string. Therefore proposals for increasing the effective length of the string have been hitherto made. For example, in the art disclosed in Japanese Patent Application Laid-Open No. 2001-252376 (patent document 1), as shown in FIG. 13, the grooves 5 are partly formed in the face part 4 of the racket frame 3 at the inner peripheral side thereof, with the grooves 5 disposed at the central portion in the thickness direction of the racket frame 3 and extending in the circumferential direction of the face part 4. According to the disclosure, the sweet area can be increased because the effective length of the deformable string can be made longer than the length between the inner peripheral edges of opposed string holes.

The present applicant proposed the construction shown in FIG. 14 as disclosed in Japanese Patent Application Laid-Open No. 2000-61004 (patent document 2). In the art disclosed therein, in at least one part of a plurality of string holes 7 formed in penetration through the inner part and outer part of the hollow racket frame 6, the inner diameter r2 of the inner hole 7*a* formed in penetration through the inner part of the racket frame is set larger than the inner diameter r1 of the outer hole 7*b* formed in penetration through the outer part thereof. In this construction, a gap is formed between the string inserted through the string hole 7 and the inner peripheral surface of the inner hole 7*a*, and the deformation support of the string is disposed at the outer hole 7*b*. Thereby the effective length of the string can be increased by the length between the inner and outer parts of the racket frame.

In the above-described racket frames 3 and 6, the increase amount of the effective length of the string is equal to the width of the racket frame or a part of the width thereof parallel with the ball-hitting face. The increase amount of the effective length of the string is very short. Therefore there is room for improvement of the construction for increasing the sweet area by increasing the effective length of the string.

Patent document 1: Japanese Patent Application Laid-Open No. 2001-252376

Patent document 1: Japanese Patent Application Laid-Open No. 2000-61004

SUMMARY OF THE INVENTION

The present invention has been made in the above-described problem. Therefore it is an object of the present invention to provide a racket frame in which the sweet area can be increased outstandingly and effectively by increasing the effective length of strings.

To achieve the object, the first invention provides a racket including a racket frame in which a yoke part is disposed between left and right portions of a bifurcated throat part continuous with a head part and with a shaft part; a ball-hitting face is formed with the yoke part and the head part; and the head part and the yoke part have a plurality of string holes formed in penetration therethrough to insert longitudinal and transverse strings therethrough.

In this construction, longitudinal string holes formed outside left and right sides of the yoke part connected with the left and right portions of the throat part are extended to the throat part to form extended longitudinal string holes open on an outer surface of the throat part.

The racket frame of the present invention is formed with a tubular body composed of a laminate of prepregs. The string holes are formed in penetration through the inner peripheral wall of the racket frame and the peripheral wall thereof.

Two extended longitudinal string holes are formed outside each of the left and right sides of the yoke part. An axial line of each of the extended longitudinal string holes is almost parallel with a longitudinal direction (a direction in which the longitudinal strings are stretched) of the racket frame. More specifically, the axial line of each of the extended longitudinal string holes forms ±5° and favorably ±1° with the longitudinal direction.

The diameter of each of the extended longitudinal string holes formed in penetration through the throat part is so set that a gap is formed between the inner peripheral surface of each of the extended longitudinal string holes and one longitudinal string penetrated therethrough.

Because the gap is provided between the inner peripheral surface of the extended longitudinal string hole and the longitudinal string, the longitudinal string is wound on the outer surface of the throat part, with the longitudinal string in contact with the peripheral edge of the outer opening of the extended longitudinal string hole. Therefore the deformation support of the longitudinal string can be disposed at the peripheral edge of the outer opening.

The string to be inserted through the extended longitudinal string hole is inserted through a grommet inserted into the extended longitudinal string hole from the outside. Therefore it is preferable to form a gap between the peripheral surface of the grommet and the inner peripheral surface of the inner opening of the extended longitudinal string hole.

As described above, in the first invention, the longitudinal string hole formed outside the left and right ends of the yoke part connected with the left and right portions of the throat part respectively is extended to the throat part to form the extended longitudinal string holes open on the outer surface of the throat part. In this construction, the longitudinal strings penetrated through the extended longitudinal string holes respectively are folded back on the outer surface of the throat part, with the longitudinal strings in contact with the peripheral edge of the outer opening. Therefore the effective length of each of the longitudinal string can be increased to a high extent.

The longitudinal strings penetrated through the extended longitudinal string holes respectively are disposed outside the left and right ends of the sweet area disposed at the central portion of the ball-hitting face. Therefore the sweet area can be greatly increased in the transverse direction of the racket frame.

The second invention provides a racket including a racket frame in which a yoke part is disposed between left and right portions of a bifurcated throat part continuous with a head part and with a shaft part; a ball-hitting face is formed with the yoke part and the head part; and the head part and the yoke part have a plurality of string holes formed in penetration therethrough to insert longitudinal and transverse strings therethrough.

In this construction, one or more longitudinal strings penetrated through longitudinal string holes formed in penetration through the yoke part are extended to a space sandwiched between the left and right portions of the throat part and stretched and mounted in one or more extended longitudinal string holes respectively formed in penetration through the throat part.

In a racket composed of the racket frame having the above-described construction, the longitudinal string penetrated through the string hole of the yoke part is extended to an approximately triangular space surrounded with the yoke part and the left and right portions of the throat part. Thereafter the longitudinal string is stretched into the extended longitudinal string hole formed in penetration through the throat part. Therefore it is possible to greatly increase the length of the longitudinal string stretched from the top of the racket frame to the yoke part and thereby effectively increase the sweet area in the longitudinal direction of the racket frame.

The number of longitudinal strings to be inserted through the longitudinal string holes of the yoke part respectively is normally 6 to 12. It is unnecessary to extend all the longitudinal strings to the space surrounded with the yoke part and the left and right portions of the throat part and insert them through the extended longitudinal string holes formed in penetration through the throat part. As described above, the above-described effect can be obtained by extending at least one longitudinal string to the space surrounded with the yoke part and the left and right portions of the throat part.

In inserting the longitudinal strings into the extended longitudinal string holes, all of the longitudinal strings penetrated through the longitudinal string holes of the yoke part may be extended to the space surrounded with the yoke part and the left and right portions of the throat part and penetrated through the extended longitudinal string holes formed in penetration through the throat part. But considering that the ball-hitting face of the racket is narrow and long, it is preferable to increase the sweet area transversely. Therefore it is preferable that at least one longitudinal string penetrated through each of the left and right longitudinal string holes of the yoke part proximate to the left and right portions of the throat part is extended to the space surrounded with the left and right portions of the throat part and the yoke part and then inserted through the extended longitudinal string holes formed in penetration through the left and right portions of the throat part. For example, it is favorable to extend one or two longitudinal strings penetrated through each of the left and right longitudinal string holes of the yoke to the space surrounded with the yoke part and the left and right portions of the throat part and penetrate them through the extended longitudinal string holes formed in penetration through the throat part.

It is preferable that a portion of the outer side wall of the throat part where the outer opening of the extended longitudinal string hole is disposed is vertical to the direction in which the longitudinal string is stretched. When the portion of the throat part where the outer opening is disposed is set vertically to the direction in which the longitudinal string is stretched, the position of the extended longitudinal string hole to be formed can be easily confirmed. Further it is possible to prevent a portion of the racket frame and a portion of the grommet on which the longitudinal string is stretched from forming an acute angle to the extended longitudinal string. Therefore it is possible to prevent the extended longitudinal string from being cut and the racket frame or the grommet from being broken.

In the construction of the racket frame composed in combination of the first invention and the second invention, the longitudinal strings penetrated through the longitudinal string holes disposed outside the left and right sides of the yoke part and the longitudinal strings penetrated through the longitudinal string holes disposed in the central portion between longitudinal string holes disposed at the left and right sides of the yoke part are both penetrated through the extended longitudinal string holes extended to the throat part. Thereby it is possible to increase the effective length of each of the longitudinal strings and hence extend the sweet area transversely and longitudinally.

In the second invention, the axial line of each of the extended longitudinal string holes formed in penetration through the throat part is almost parallel with that of the longitudinal direction (direction in which longitudinal strings are stretched) of the racket frame.

That is, the longitudinal strings are stretched in parallel with the axial line of the racket frame. Thus when the extended longitudinal string holes are formed in parallel with the axial line of the racket frame, each of the longitudinal strings does not contact the peripheral edge of the inner opening of the corresponding extended longitudinal string, but contacts the peripheral edge of the outer opening of the extended longitudinal string hole. Thus the deformation support of the longitudinal string can be moved from the peripheral edge of the inner opening of the extended longitudinal string hole to the peripheral edge of the outer opening thereof. Conventionally the effective length of the longitudinal string is in the range from the top of the racket frame to the yoke part thereof. But according to the present invention, it is possible to increase the effective length of the longitudinal string from the top of the racket frame to the throat part thereof. Further the effective length of the longitudinal string can be increased by the length of the extended longitudinal string hole formed in penetration through the throat part.

Let it be supposed that when the throat part is provided with the extended longitudinal string hole, parallel with the axial direction of the racket frame, in penetration through the throat part at a position proximate to the shaft part to receive the longitudinal string which has passed through the longitudinal string hole disposed at the center of the yoke part, the extended longitudinal string hole reaches the shaft part. Thus it is impossible to form an axially extended through-hole for receiving the longitudinal string in penetration through the shaft part.

Therefore it is impossible to form intersection angle of the extended longitudinal string hole at smaller than 12 degrees to the axial direction of the racket frame. But it is preferable to form a possible smallest intersection angle of the extended longitudinal string hole to the axial direction of the racket frame. To this end, it is preferable to decrease the intersection angle between the axial line of the racket frame and that of the inner opening formed on the inner wall of the throat part as small as possible and increase the intersection angle between the axial line of the racket frame and that of the longitudinal string hole formed on the outer wall of the throat part in the above-described angle range. This construction is capable of making the degree of intersecting between the edge of the inner opening and the string gentle.

To increase the effective length of the string, it is preferable to align the penetration direction of the extended longitudinal string hole with the direction in which the longitudinal string is stretched. As the extended longitudinal string hole formed in penetration through the throat part becomes nearer to the shaft part, the length between the extended longitudinal string hole and the yoke part becomes increasingly long. Therefore by making the penetration direction of the extended longitudinal string hole in the vicinity of the shaft part oblique, the effective length of the string can be sufficiently increased, even though the deformation support of the longitudinal string is disposed at the inner opening.

In the second invention, the dimension of the longitudinal string hole formed in penetration through the yoke part sandwiched between the left and right portions of the throat part is so set that a gap is formed between an inner peripheral surface of the longitudinal string hole and the longitudinal string penetrated therethrough. The dimension of the longitudinal string hole formed in penetration through the yoke part is so set that one longitudinal string or a plurality of the longitudinal strings is penetrated therethrough.

That is, the string hole to be formed in penetration through the yoke part is circular, and the dimension of the string hole is so set that only one longitudinal string is inserted through the string hole. The inner diameter of the circular string hole is set larger than the outer diameter of one longitudinal string. Thereby the longitudinal string is extended to the space sandwiched between the left and right portions of the throat part without contact between the longitudinal string and the inner peripheral surface of the string hole.

It is possible that the string hole to be formed in penetration through the yoke part is transversely long and that dimension of the transversely long string hole is so set that a plurality of longitudinal strings penetrated through the string hole do not contact the inner peripheral surface thereof.

It is possible that dimension of the extended longitudinal string hole to be formed on the throat part is so set that not one longitudinal string but a plurality of longitudinal strings is penetrated therethrough. In this case, it is possible that a bumper and cylindrical grommets projected from the bumper at certain intervals are mounted on the outer surface of the throat part, with the grommets inserted into the extended longitudinal string holes and that the longitudinal strings are mounted in the extended longitudinal string holes respectively by inserting the longitudinal strings into the grommets and winding them on the bumper.

As described above, according to the first invention, it is possible to increase the effective length of the longitudinal string disposed at the left and right sides of the sweet area of the ball-hitting face. Therefore the sweet area can be increased transversely.

According to the second invention, it is possible to increase the effective length of the longitudinal string disposed in the sweet area of the ball-hitting face. Therefore the sweet area can be increased longitudinally. Of longitudinal strings penetrated through the throat part, the longitudinal strings disposed at the left and right sides of the yoke part are extended to the space sandwiched between the left and right portions of the throat part. Therefore the sweet area can be increased transversely.

In the construction of the racket frame composed in combination of the first invention and the second invention, it is possible to increase the sweet area transversely and longitudinally.

DETAILED DESCRIPTION OF THE PREFERRED EMBODIMENTS

Figure 1A:
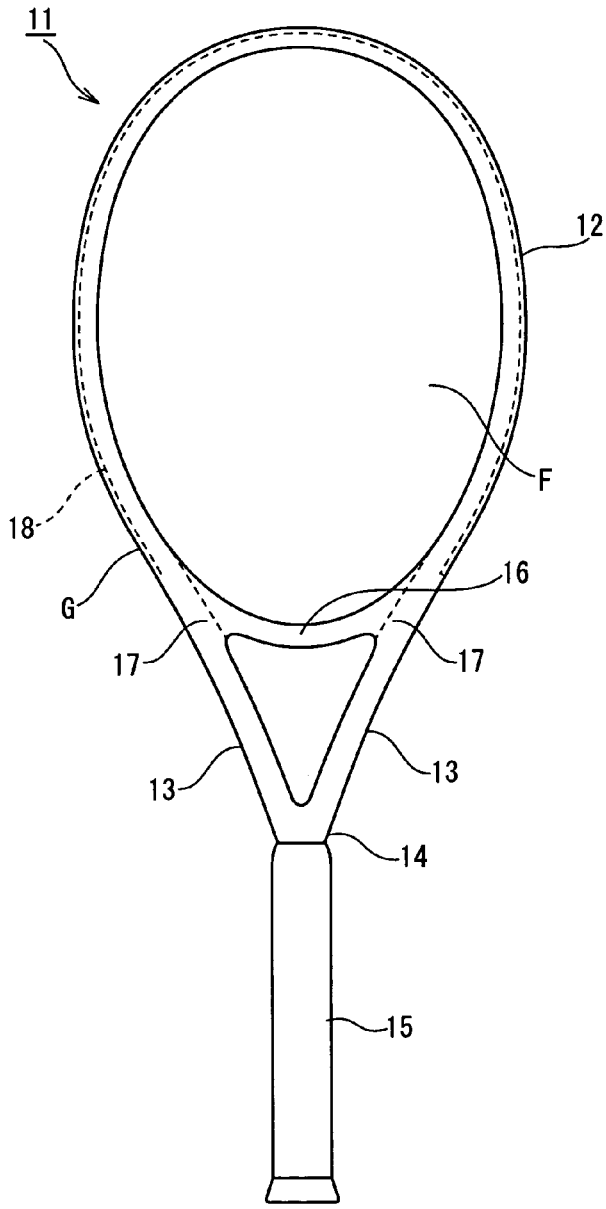
FIG. 1A is a front view showing a racket according to a first embodiment of the present invention.

The embodiments of the present invention will be described below with reference to the drawings. Rackets of the embodiments which will be described below are regulation-ball tennis rackets.

FIGS. 1 through 4 show a racket according to a first embodiment of the present invention.

A racket frame 11 is composed of a tubular body made of fiber reinforced prepreg sheets. The racket frame 11 has a head part 12, a throat part 13, a shaft part 14, and a grip part 15. These parts are continuously formed. The throat part 13 connecting the head part 12 and the shaft part 14 to each other is bifurcated. A yoke part 16 is formed between a pair of the throat parts 11. A ball-hitting face F is surrounded with the yoke part 16 and the head part 12. A string-stretching part is formed with the head part 12 and the throat part 13.

Figure 1B:
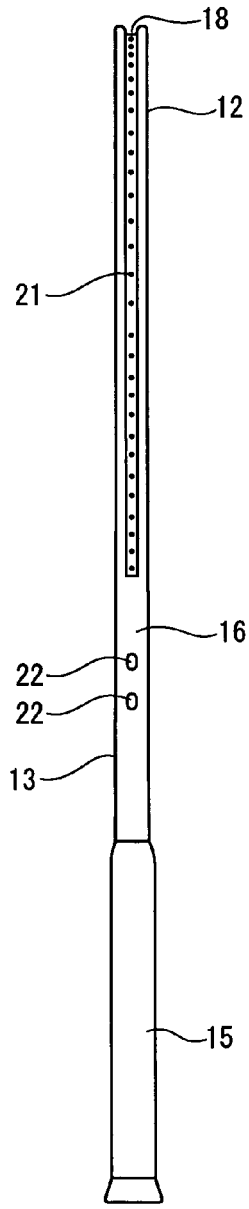
FIG. 1B is a side view showing the racket shown in FIG. 1A.

As shown in FIG. 1, a string groove 18 is circumferentially continuously formed on the head part 12 at the peripheral side thereof. Longitudinal and transverse string holes 21 are formed in penetration through the head part 12 in the range from the bottom surface (peripheral side of racket frame) of the string groove 18 to the inner peripheral surface of the head part 12 at which the inner edges of the longitudinal and transverse string holes 21 contact the periphery of the ball-hitting face F. The longitudinal string holes 24 are also formed in penetration through the inner and outer walls of the yoke part 16.

Figure 2:
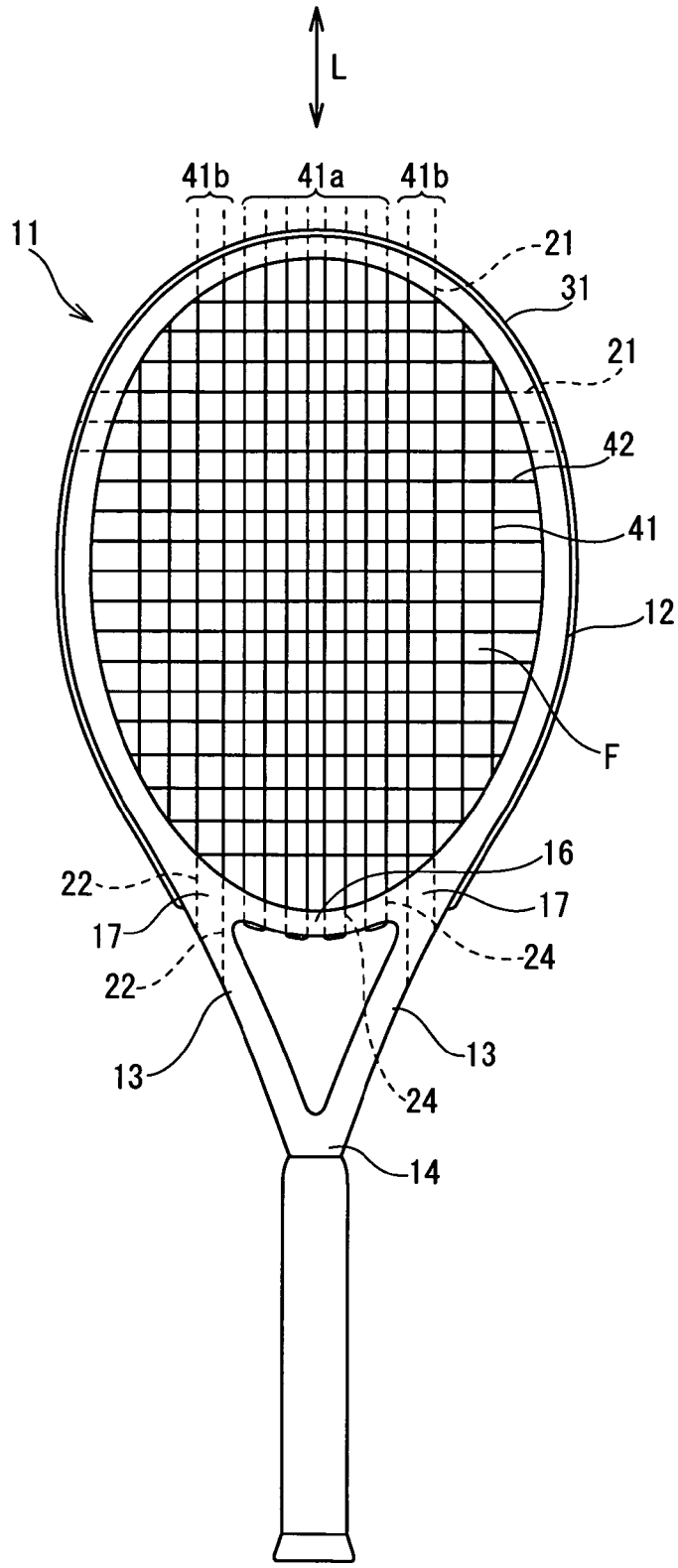
FIG. 2 is a front view showing a state in which strings are stretched and mounted in string holes formed in penetration through string holes of the racket shown in FIG. 1.
Figure 3:
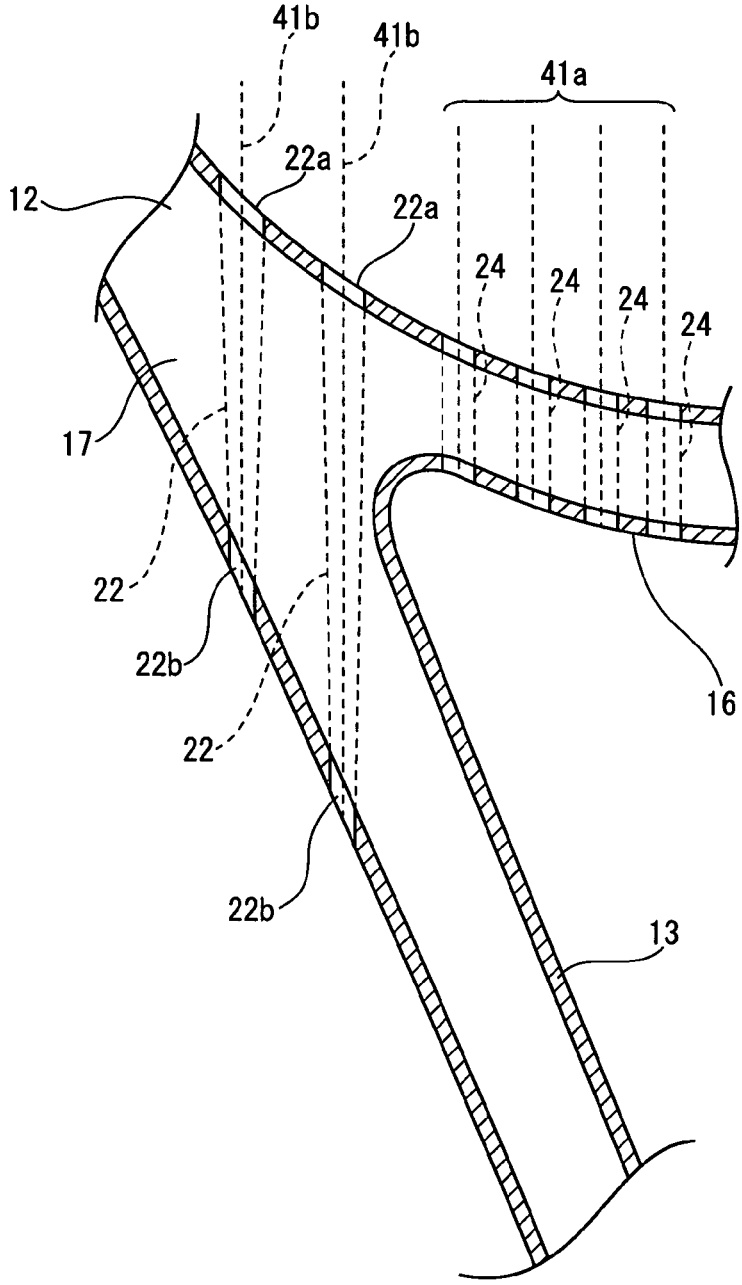
FIG. 3 is a sectional view showing enlarged main parts of the racket frame shown in FIG. 2.

As shown in FIGS. 2 and 3, two extended longitudinal string holes 22 are formed in left and right triangular connection portions 17 forming a juncture between each of left and right portions of the throat part 13 and the head part 12 and between left and right ends of the yoke part 16. The extended longitudinal string holes 22 are formed in penetration through the connection portion 17 along an extension of a stretched direction (longitudinal axial line of racket frame) L of the longitudinal strings. Inner openings 22*a* are formed on the inner peripheral surface of the connection portion 17. Peripheral openings 22*b* are formed on the peripheral surface of the throat part 13.

As shown in FIG. 2, longitudinal strings 41 and transverse strings 42 are stretched and mounted at the longitudinal and transverse string holes 21 formed in the head part 12, the longitudinal string holes 24 formed in the yoke part 16, and the extended longitudinal string holes 22 formed in the throat part 13, with the longitudinal strings 41 in parallel with the axial line L of the racket frame in the longitudinal direction thereof and with the transverse strings 42 orthogonal to the longitudinal strings 41 (in minor-axis direction of racket frame).

The inner openings 22*a* (disposed at ball-hitting face side of connection portion 17) of the extended longitudinal string holes 22 formed in the connection portion 17 disposed outside the left and right ends of the yoke part 16 are so formed that a gap allowing the longitudinal string 41*b* to be displaceable is formed between the longitudinal string 41*b* passing through the inner opening 22*a* and the inner peripheral surface of the inner opening 22*a*.

The axis of each extended longitudinal string hole 22 is extended from the inner opening 22*a* disposed at the side of the ball-hitting face F to the throat part 13 in substantially parallel with the longitudinal direction L (longitudinal string-stretched direction) of the racket frame. More specifically, the axis of the extended longitudinal string hole 22 forms ±1° with the longitudinal direction L. Thus the extended longitudinal string hole 22 slantly penetrates through the throat part 13 which inclines with respect to the longitudinal direction L. Therefore the outer opening 22*b* disposed on the peripheral surface of the throat part 13 is elliptic. A gap is formed between the inner peripheral surface of the outer opening 22*b* and the longitudinal string 41*b*. The longitudinal string 41*b* is wound on the outer surface of the throat part 13 with the longitudinal string 41*b* in contact with only the peripheral edge of the outer opening 22*b*.

Figure 4:
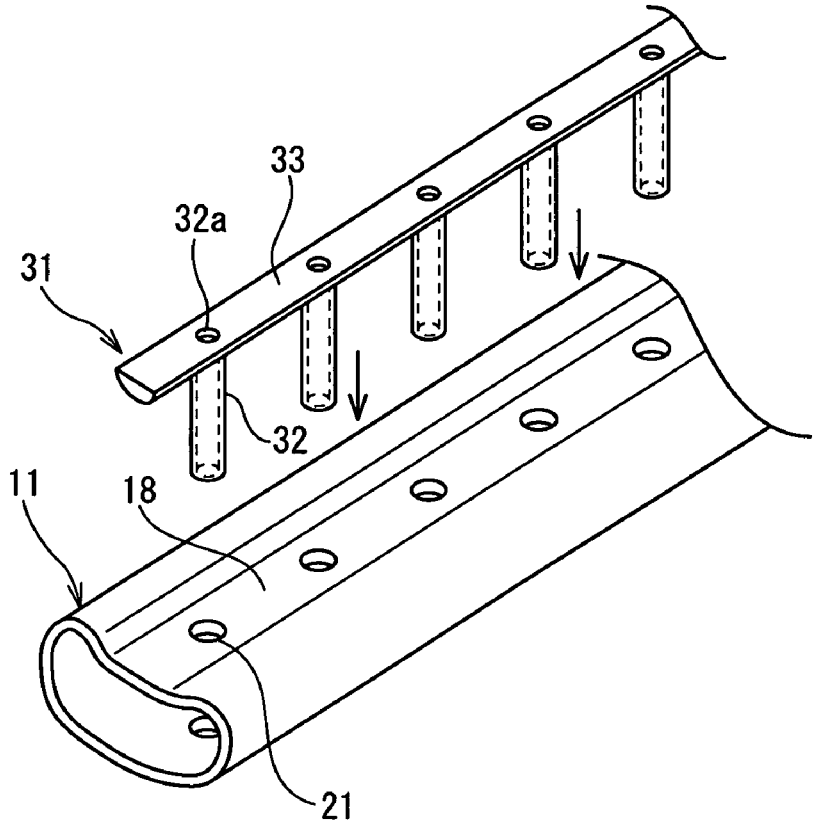
FIG. 4 is a perspective view showing the racket frame and a string protection member.

When the longitudinal string 41 and the transverse string 42 are mounted on the string holes by stretching them, a string protection member 31, shown in FIG. 4, which has a bumper 33 and a grommet 32 is mounted on the string groove 18, with the string protection member 31 interposed between the strings 41, 42 and the racket frame 11. The string protection member 31 is composed of a plurality of grommets 32 having insertion through-holes 32*a* through which the strings 41, 42 are inserted and the bumper 33 connecting the base portions of the grommets 32 to each other, with the base portions of the grommets 32 projecting inward. The string protection member 31 can be made of thermoplastic resin or thermosetting resin. Nylon resin and urethane resin are favorable because these resins allow the string protection member 31 to have a high strength and flexibility. In this respect, the nylon resin is especially favorable.

As shown in FIG. 2, in a tennis racket formed by mounting the longitudinal strings 41 and the transverse strings 42 on the string holes by stretching them, longitudinal strings 41*a*, disposed at the central portion of the ball-hitting face F, which pass through the top portion of the head part 12 penetrate through the string holes 24 of the yoke part 16 respectively and are wound on the outer surface of the yoke part 16 and folded back toward the ball-hitting face.

Two longitudinal strings 41*b* (four in total) disposed at the left and right sides of the longitudinal strings 41*a* disposed in the central portion of the ball-hitting face penetrate through the extended longitudinal string holes 22 of the connection portion 17 respectively. The longitudinal strings 41*b* are inserted through the inner openings 22*a* disposed at the side of the ball-hitting face F of the connection portion 17 respectively, with a gap provided between the inner peripheral surface of the string hole 22 and the longitudinal string 41*b*. Each of the longitudinal strings 41*b* is wound on the outer surface of the throat part 13, with the longitudinal string 41*b* in contact with the peripheral edge of the outer opening 22*b* disposed on the outer surface of the throat part 13. Therefore the deformation support of the longitudinal string 41 is disposed at the outer opening 22*b*. Thereby the effective length of the longitudinal string 41*b* can be increased by the length of the extended longitudinal string hole 22.

In the first embodiment, the four longitudinal strings 41*b* of the 16 longitudinal strings 41 can be greatly increased in the effective length thereof. The longitudinal strings 41*b* increased in the effective length thereof are disposed at the left and right sides of the sweet area disposed at the central portion of the ball-hitting face. Therefore the sweet area can be increased in the transverse direction of the racket frame.

Figure 5:
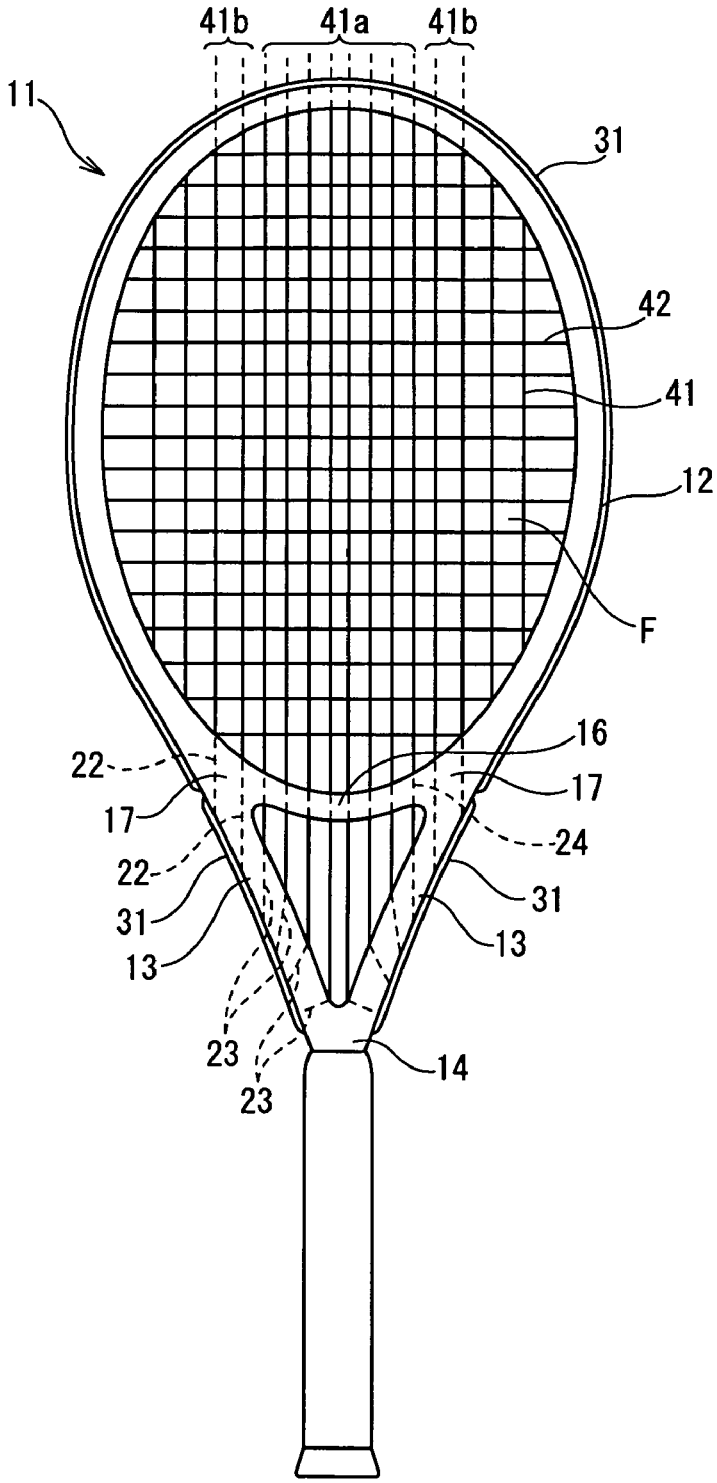
FIG. 5 is a front view showing a state in which strings are stretched and mounted in string holes of a racket according to a second embodiment of the present invention.
Figure 6:
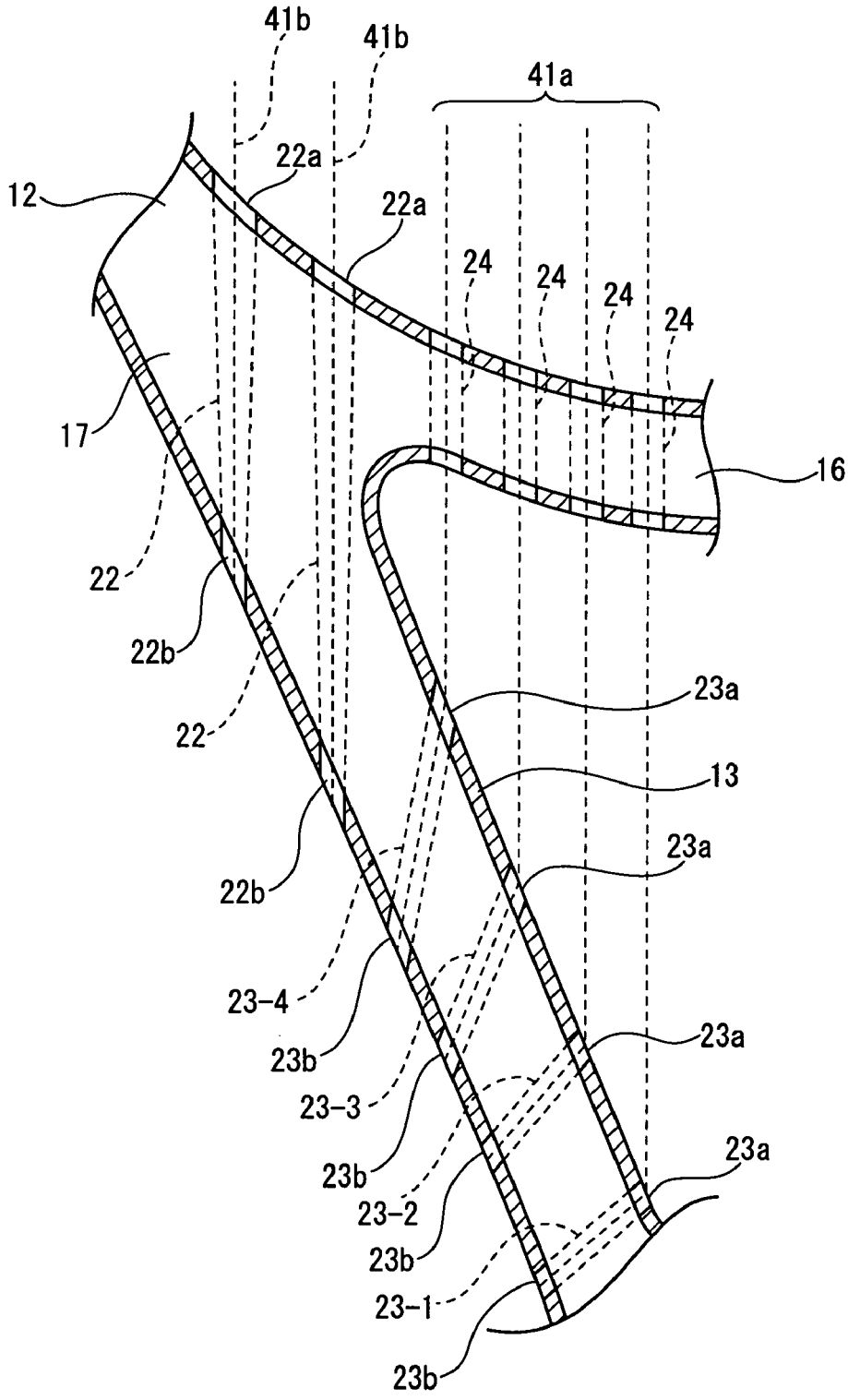
FIG. 6 is a sectional view showing enlarged main parts of the racket frame shown in FIG. 5.

FIGS. 5 and 6 show the second embodiment.

In the second embodiment, extended longitudinal string holes 23 are formed on the throat part 13 to stretch and mount longitudinal strings 41*a* therein by extending the longitudinal strings 41*a* which have been penetrated through the longitudinal string holes 24 of the yoke part 16 respectively to a space sandwiched between the left and right portions of the throat part 13. Similarly to the first embodiment, the extended longitudinal string holes 22 are formed in the triangular connection portion 17 disposed at outside the left and right sides of the yoke part 16. The constructions of other parts of the racket of the second embodiment are the same as those of the first embodiment.

As shown in FIG. 6, in forming four extended longitudinal string holes 23 at the left and right portions of the throat part 13, inner openings 23*a* formed on the inner peripheral surface of the throat part 13 are disposed along an extension of a stretched direction L the longitudinal strings 41*a* penetrated through the string holes 24 of the yoke part 16.

The penetration directions of the extended longitudinal string holes 23 are oblique with respect to the stretched direction L of the longitudinal strings 41*a*. More specifically, the extended longitudinal string holes 23 penetrate through the throat part 13 from the inner opening 23*a* to the outer opening

23*b* formed in penetration through the outer side wall of the throat part 13, with the extended longitudinal string holes 23 inclining outward.

The inclination of an extended longitudinal string hole 23-1 in the vicinity of the shaft part 14 is set to the maximum a of the inclinations of the other three extended longitudinal string holes 23-2, 23-3, and 23-4 with respect to the stretched direction (longitudinal direction of racket frame) L of the longitudinal strings. The inclination of the extended longitudinal string hole disposed near the connection portion 17 is smaller than that of the extended longitudinal string hole disposed far from the connection portion 17. That is, the angle between the extended longitudinal string holes and the stretched direction L of the longitudinal strings 41*a* becomes gradually smaller in the order of the extended longitudinal string holes 23-1, 23-2, 23-3, and 23-4.

One longitudinal string 41*a* is inserted through the circular string hole 24 formed in penetration through the yoke part 16. The inner diameter of the string hole 24 is so set that there is a gap between the inner peripheral surface of the string hole 24 and the longitudinal string 41*a* and that the inner peripheral surface of the string hole 24 and the longitudinal string 41*a* do not contact each other.

In the racket of the second embodiment, eight longitudinal strings 41*a* stretched in the sweet area disposed at the central portion of the ball-hitting face F penetrate through the string holes 24 formed in penetration through the yoke part 16. The eight longitudinal strings 41*a* are extended to the space surrounded with the yoke part 16 and the left and right portions of the throat part 13 and inserted into the extended longitudinal string holes 23 respectively. Thereafter the eight longitudinal strings 41*a* are wound on the outer surface of the throat part 13 to mount them on the throat part 13 by folding them back.

Therefore the effective length of the longitudinal string 41*a* passing through the sweet area is extended to the point of contact between the longitudinal string 41*a* and the edge of the outer opening 23*b*. Therefore the sweet area is increased in the longitudinal direction of the racket frame.

Similarly to the first embodiment, the longitudinal strings 41*b* disposed at the left and right sides of the sweet area disposed at the central portion of the ball-hitting face are inserted through the extended longitudinal string holes 22 formed in penetration through the throat part. Therefore the sweet area is increased in the transverse direction of the racket frame, similarly to the first embodiment.

Figure 7:
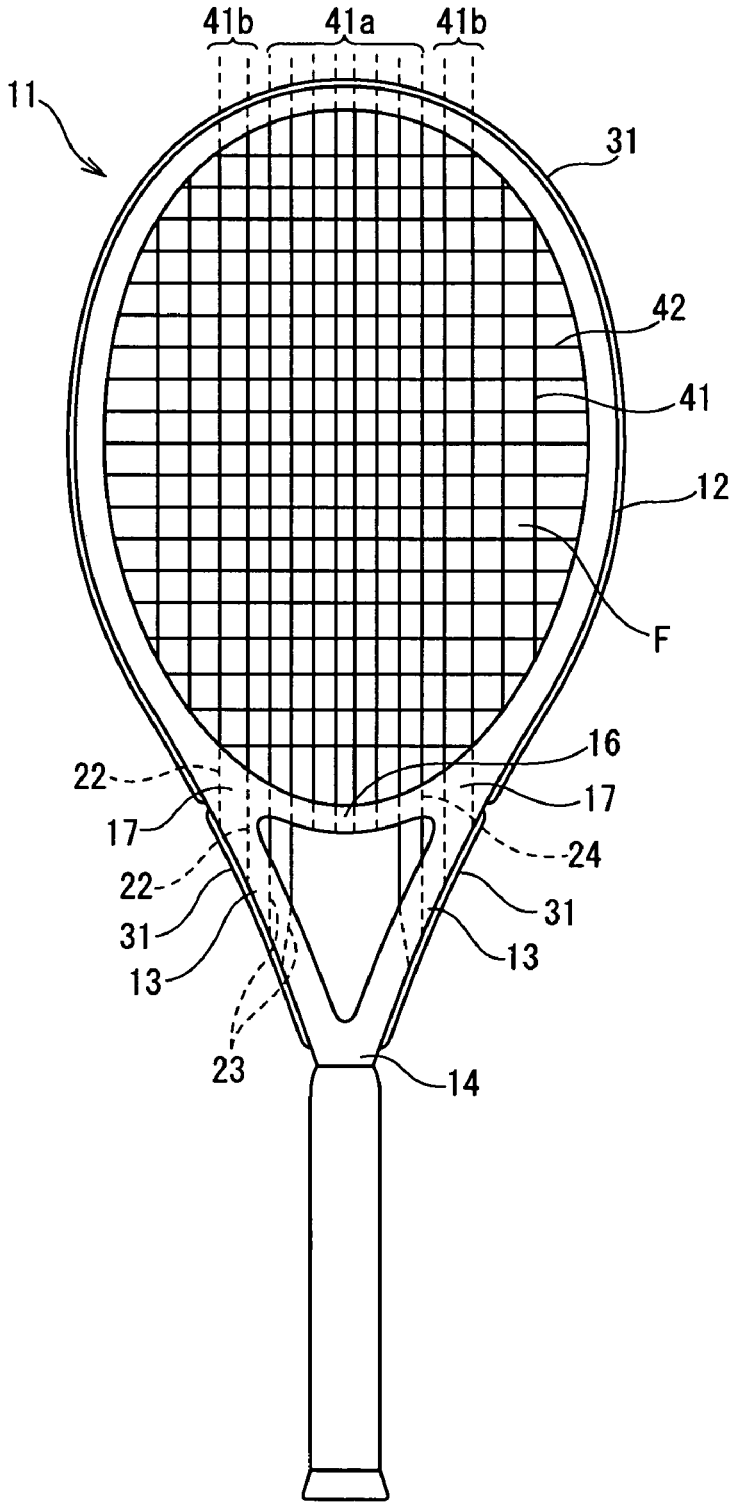
FIG. 7 is a front view showing a racket of a first modification of the second embodiment.

FIG. 7 shows the first modification of the second embodiment. Only longitudinal strings 41*a* penetrated through two longitudinal string holes 24 of the yoke part 16 proximate to each of the left and right portions of the throat part 13 are extended to the space surrounded with the left and right portions of the throat part 13 and the yoke part 16. After the longitudinal strings 41*a* are inserted through the extended longitudinal string holes 23 formed in penetration through the left and right portions of the throat part 13, the four longitudinal strings 41*a* are wound on the outer surface of the throat part 13 and folded back.

In the second embodiment shown in FIGS. 5 and 6, all the longitudinal strings passing through the yoke part 16 are extended to the space surrounded with the yoke part 16 and the left and right portions of the throat part 13 and wound on the outer surface of the throat part 13 respectively, with the longitudinal strings in penetration through the extended longitudinal string holes 23 respectively. In the first modification, only two longitudinal strings disposed at the left and right sides of the yoke part 16 are extended to the space surrounded with the left and right portions of the throat part.

By extending only the longitudinal strings 41*a* penetrated through the left and right portions of the yoke part 16 to the throat part, the long and narrow sweet area can be increased in the transverse direction of the racket frame.

Figure 8:
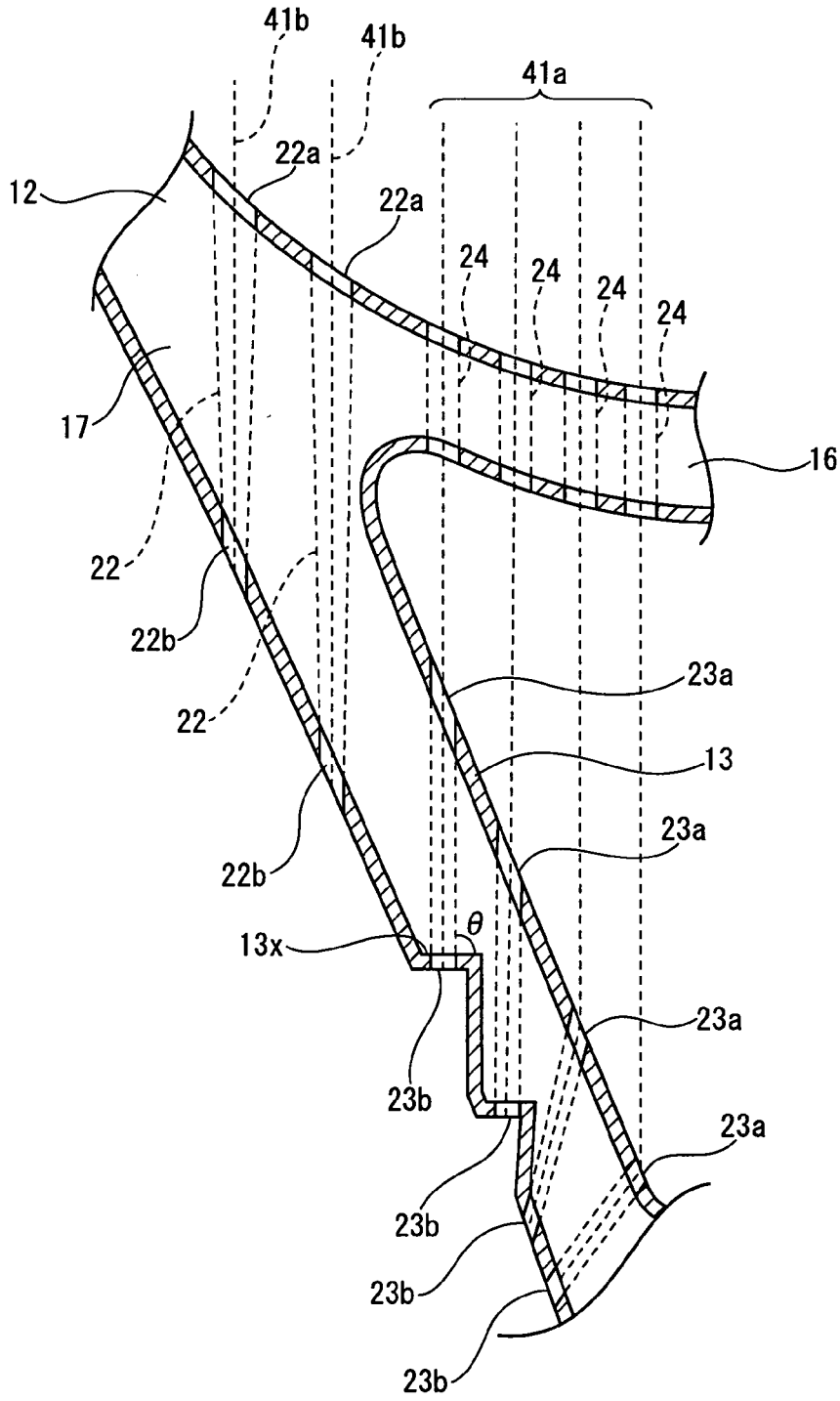
FIG. 8 is a sectional view showing enlarged main parts of the racket frame of a second modification of the second embodiment.

FIG. 8 shows the second modification of the second embodiment. In the second modification, a vertical portion 13*x* vertical to the stretched direction L of the longitudinal string is formed at a portion of the outer side wall of the throat part 13 where the outer opening 23*b* of the extended longitudinal string hole 23 is formed. The outer opening 23*b* is formed on the vertical portion 13*x*.

The angle θ of the vertical portion 13*x* at which the outer opening 23*b* is formed does not necessarily have to be vertical to the direction L in which the longitudinal string is stretched, but may be set to 70 to 110 degrees.

Although the angle θ is specified in the range of 70 to 110 degrees in the second modification of the second embodiment, the angle θ can be specified in the present invention.

When the portion of the throat part 13 where the outer opening 23*b* is disposed is vertical to the direction in which the longitudinal string is stretched, as described above, it is possible to easily confirm the position of the extended longitudinal string hole to be formed. Further it is possible to prevent a portion of the racket frame and a portion of the grommet on which the longitudinal string is stretched from forming an acute angle to the extended longitudinal string. Therefore it is possible to prevent the extended longitudinal string from being cut and the racket frame or the grommet from being broken.

Figure 9:
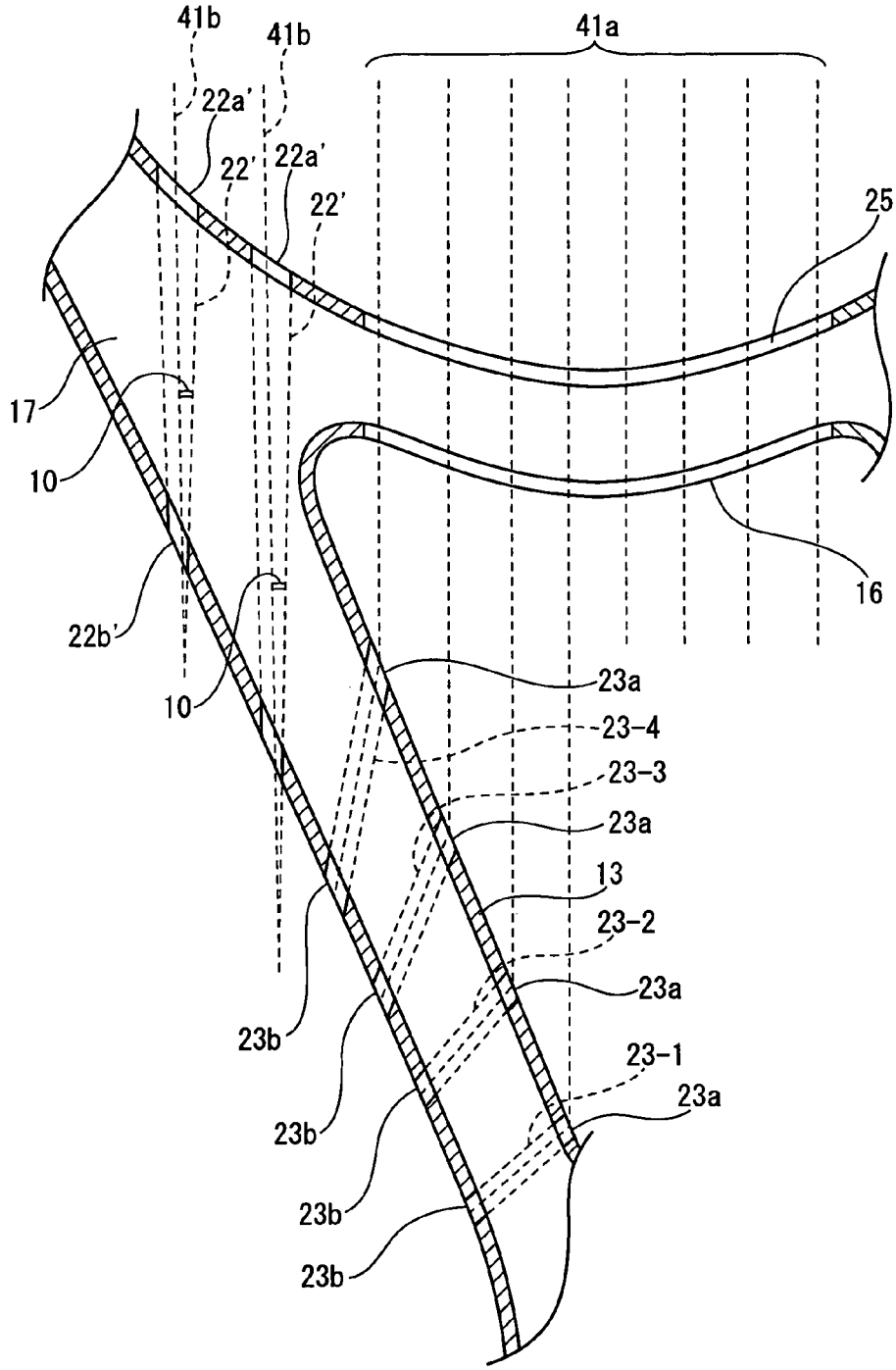
FIG. 9 is a sectional view showing enlarged main parts of the racket frame of a third modification of the second embodiment.

FIG. 9 shows the third modification of the second embodiment. In the third modification, one transversely long string hole 25 is formed in penetration through the yoke part 16. As shown in FIG. 9, eight longitudinal strings 41*a* passing through the top portion of the head part 12 are penetrated through the transversely long string hole 25 and stretched and mounted in the extended longitudinal string holes 23 of the throat part 13. The width and length of the transversely long string hole 25 is so set that the inner peripheral surface thereof does not contact the longitudinal strings 41*a*.

The third modification has the same construction as that of the second embodiment. Thus the same parts of the third modification as those of the second embodiment are denoted by the same reference numerals as those of the second embodiment, and description thereof is omitted herein.

In the third modification, the eight longitudinal strings 41*a* stretched from the top portion of the head part 12 are mounted in the extended longitudinal string holes 23 of the throat part 13 without contact between the eight longitudinal strings 41*a* and the inner peripheral surface of the transversely long string hole 25 of the yoke part 16. Therefore the effective length of the longitudinal strings 41*a* can be greatly increased.

Figure 10:
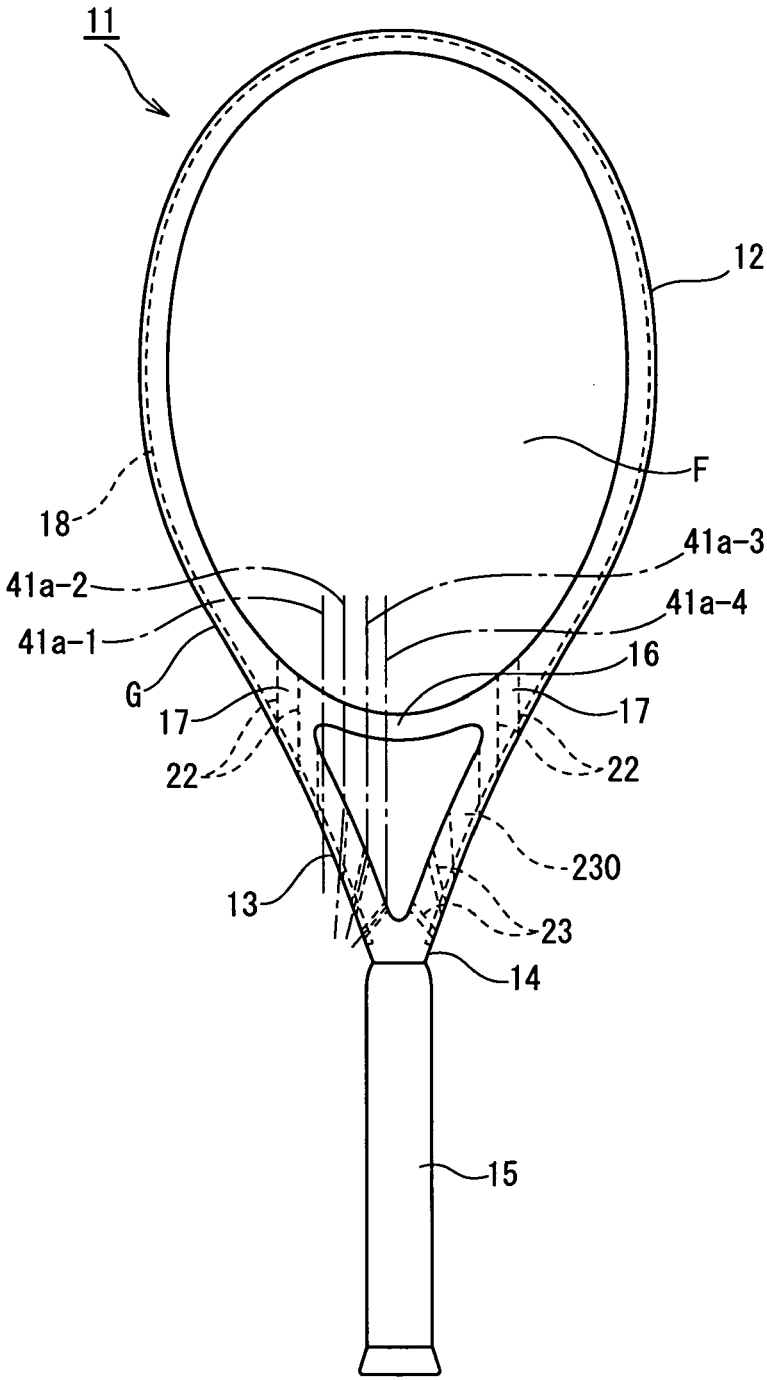
FIG. 10 is a schematic view showing the fourth embodiment of the present invention.
Figure 11:
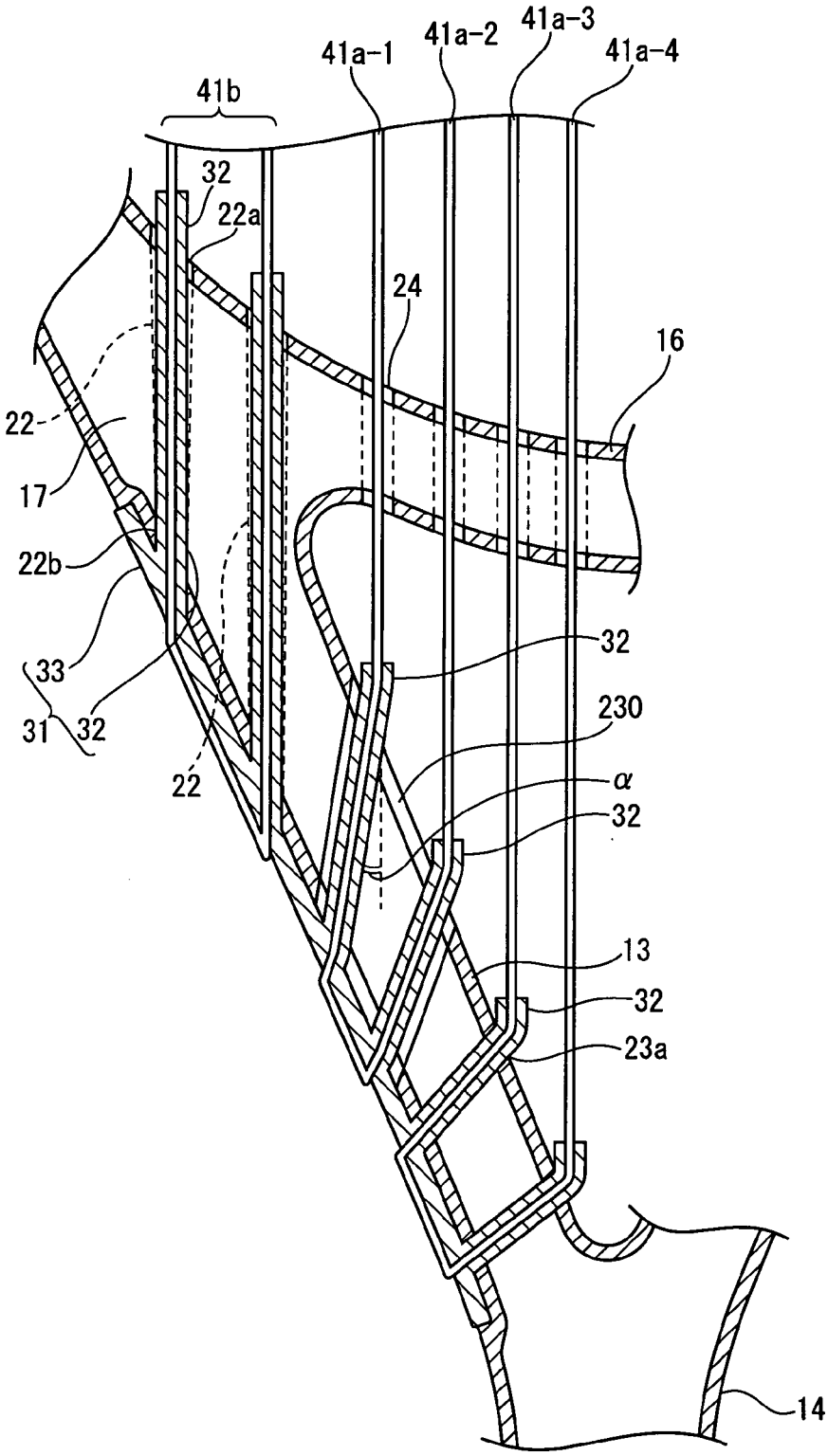
FIG. 11 is a sectional view showing enlarged main parts of the racket frame shown in FIG. 10.
Figure 12:
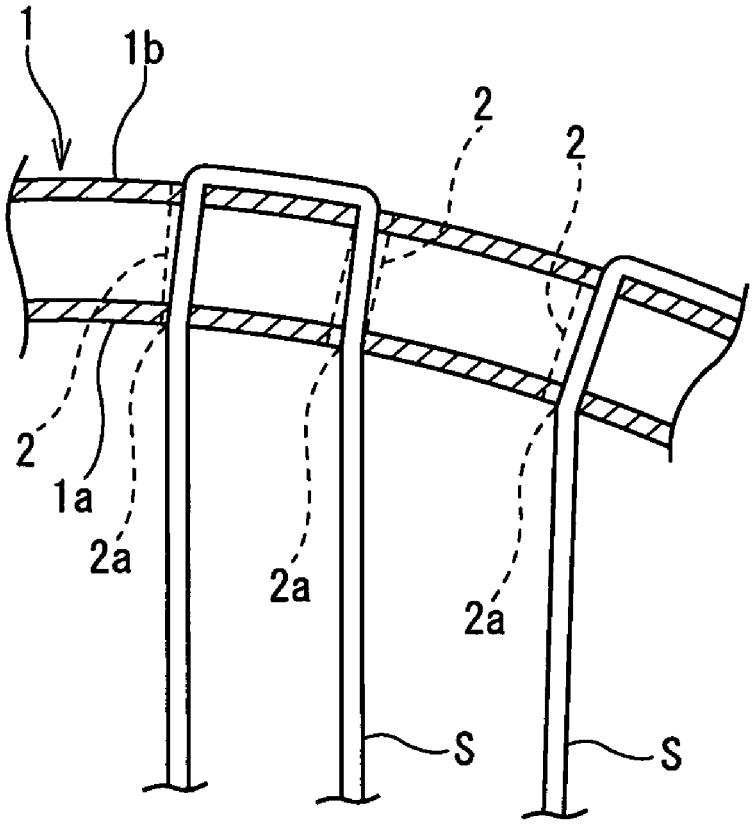
FIG. 12 shows a conventional art of inserting strings into string holes.
Figure 13:
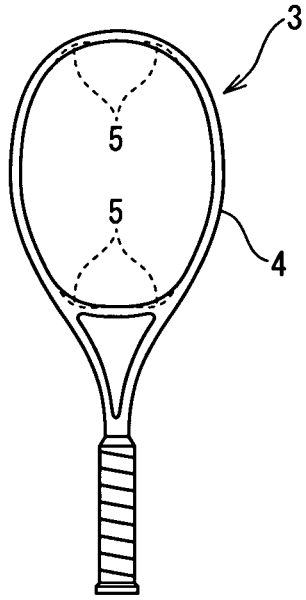
FIG. 13 shows another conventional art.
Figure 14:
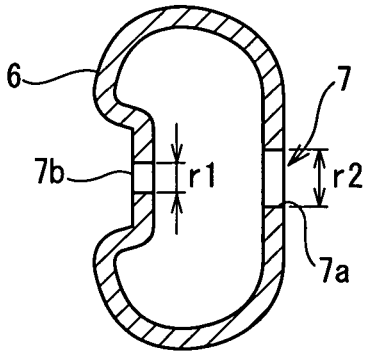
[Prior Art] Fig. 14
FIG. 14 shows still another conventional art.

FIGS. 10 and 11 show the fourth embodiment.

In the fourth embodiment, unlike the second embodiment, the head-side two string holes at the left and right portions of the throat part 13 are formed as one extended longitudinal string hole 230 having a size allowing two longitudinal strings 41*a*-1 and 41*a*-2 to be penetrated therethrough. Similarly to the second embodiment, two extended longitudinal string holes 23 are formed in penetration through each of the left and right portions of the throat part 13 to penetrate longitudinal strings 41*a*-3 and 41*a*-4 therethrough respectively.

The string protection member 31 having the bumper 33 and the grommet 32 is mounted on each of the left and right portions of the throat part 13. Two grommets 32 are inserted through the extended longitudinal string hole 230 to insert the two longitudinal strings 41*a*-1 and 41*a*-2 therethrough.

In the above-described construction, two longitudinal strings 41*a*-1 and 41*a*-2 disposed at each of the left and right positions (four longitudinal strings in total) mounted in the extended longitudinal string hole 230 formed in penetration through the throat part 13 are allowed to deform to a high extent when a ball is hit with a racket composed of the racket frame of the fourth embodiment. In addition, the restitution performance of the racket frame can be enhanced by the four longitudinal strings disposed in the central portion of the ball-hitting face.

What is claimed is:

1. A racket comprising a racket frame in which a yoke part is disposed between left and right portions of a bifurcated throat part continuous with a head part and with a shaft part; a space is bounded by said yoke part and said left and right portions of said throat part; a ball-hitting face is formed with said yoke part and said head part; and said head part and said yoke part have a plurality of string holes formed in penetration therethrough to insert longitudinal and transverse strings therethrough, wherein longitudinal string holes formed through connection portions forming junctures between left and right sides of said yoke part and said left and right portions of said throat part extend into said left and right portions of said throat part to form extended longitudinal string holes open on an outer surface of said left and right portions of said throat part; and longitudinal strings extending through said longitudinal string holes are stretched respectively at an outer surface of said left and right portions of said throat, without extending into said space.

2. The racket according to claim 1, wherein two extended longitudinal string holes are formed through each of said connection portions; and an axial line of each of said extended longitudinal string holes is almost parallel with a longitudinal direction (a direction in which said longitudinal strings are stretched) of said racket frame.

3. The racket according to claim 2, wherein a dimension of each of said extended longitudinal string holes is so set that a gap is formed between an inner peripheral surface of each of said extended longitudinal string holes and one longitudinal string extending therethrough.

4. The racket according to claim 3, wherein strings are stretched in penetration through string holes and extended longitudinal string holes formed in penetration through said head part, said yoke part, and said throat part.

5. The racket according to claim 2, wherein strings are stretched in penetration through string holes and extended longitudinal string holes formed in penetration through said head part, said yoke part, and said throat part.

6. The racket according to claim 1, wherein a dimension of each of said extended longitudinal string holes is so set that a gap is formed between an inner peripheral surface of each of said extended longitudinal string holes and one longitudinal string extending therethrough.

7. The racket according to claim 6, wherein strings are stretched in penetration through string holes and extended longitudinal string holes formed in penetration through said head part, said yoke part, and said throat part.

8. The racket according to claim 1, wherein strings are stretched in penetration through string holes and extended longitudinal string holes formed in penetration through said head part, said yoke part, and said throat part.

9. A racket comprising a racket frame in which a yoke part is disposed between left and right portions of a bifurcated throat part continuous with a head part and with a shaft part: a ball-hitting face is formed with said yoke part and said head part; and said head part and said yoke part have a plurality of string holes formed in penetration therethrough to insert longitudinal and transverse strings therethrough, wherein the number of longitudinal strings extending through said longitudinal string holes of the yoke is between 6 and 12, extended longitudinal string holes are formed in said left and right portions, at least of two longitudinal strings positioned at left and right sides of the yoke part extend into a space located between said left and right portions and are inserted through said extended longitudinal string holes of said left and right portions, each of the extended longitudinal string holes are inclined to stretched direction, an inclination of the extended longitudinal string hole in the vicinity of the shaft part is set to the maximum of the inclination of the other extended longitudinal string holes, the angle between the extended longitudinal string holes and the stretched direction of the longitudinal string become gradually smaller in the order of the extended longitudinal string holes.

10. A racket comprising a, racket frame composed of a head part; a shaft part; and left and right portions of a bifurcated throat part continuous with said head part and with said shaft part; and a yoke part disposed between said left and right portions of said bifurcated throat part; and a ball-hitting face being formed with said yoke part and said head part;

said head part and said yoke part having a plurality of string holes formed in penetration therethrough to insert longitudinal and transverse strings therethrough, wherein one or more longitudinal strings penetrated through longitudinal string holes formed in penetration through said yoke part are extended to a space located between said left and right portions of said throat part and stretched and mounted in one or more extended longitudinal string holes respectively formed in penetration through said throat part, and outer opening of said extended longitudinal string holes are formed on an outer peripheral surface of said throat part, and opening portions of said extended longitudinal string holes are set to 70 to 110 degrees to stretch direction of the longitudinal string.

* * * * *